United States Patent [19]

Kellenberger et al.

[11] Patent Number: 4,917,266

[45] Date of Patent: Apr. 17, 1990

[54] DISCHARGE SPOUT CONSTRUCTION FOR COLLAPSIBLE RECEPTACLE

[75] Inventors: David Kellenberger, Sherman; Nancy Cline, Bells; Craig Nickell, Sherman, all of Tex.

[73] Assignee: Super Sack Manufacturing Corporation, Dallas, Tex.

[21] Appl. No.: 305,624

[22] Filed: Feb. 3, 1989

[51] Int. Cl.[4] ..... B65D 33/38

[52] U.S. Cl. ..... 222/105; 222/181; 383/67; 383/906

[58] Field of Search ..... 222/92, 105, 185, 181, 222/538; 383/17–18, 41, 67, 121, 906; 493/210, 226, 926, 967

[56] References Cited

U.S. PATENT DOCUMENTS

| | | | |
|---|---|---|---|
| 3,789,897 | 2/1974 | Saito | 222/105 X |
| 4,113,146 | 9/1978 | Williamson | 222/105 |
| 4,194,652 | 3/1980 | Williamson et al. | 222/185 |
| 4,224,970 | 9/1980 | Williamson et al. | 383/17 |
| 4,479,243 | 10/1984 | Derby et al. | 383/24 |
| 4,573,204 | 2/1986 | Polett | 383/41 |
| 4,759,473 | 7/1988 | Derby et al. | 222/105 |

*Primary Examiner*—Michael S. Huppert
*Attorney, Agent, or Firm*—Michael A. O'Neil

[57] ABSTRACT

An improved discharge spout construction for a collapsible receptacle where the entire assembly is constructed with one pass of a double needle sewing machine, thus enabling the construction to be accomplished in a very economical and efficient manner. The spout, the panel which covers the opening in the bottom of the receptacle and the folded triangular flaps which form the drawstring passageways are all sewed together with two spaced sew lines to create a buffer zone between product in the receptacle and the cuts forming the triangular flaps so that if the cuts tear past the first sew line, the second sew line separates the product from the tear.

9 Claims, 2 Drawing Sheets

DISCHARGE SPOUT CONSTRUCTION FOR COLLAPSIBLE RECEPTACLE

TECHNICAL FIELD

The present invention relates to collapsible receptacles for flowable materials in general and in particular to an improved discharge spout construction for a collapsible receptacle used in the storage, transportation and dispensation of flowable materials in semi-bulk quantities.

BACKGROUND OF THE INVENTION

Traditionally, the handling of flowable materials and specifically dry particulate or granular materials has presented unique problems. For instance, these materials include chemicals, minerals, fertilizers, foodstuffs, grains, agricultural products and the like. Generally, such materials have been handled chiefly by two types of material handling systems. Where large quantities of material are required, specialized bulk handling equipment is used. For example, materials are loaded into a truck, railroad car or barge at the supply location and then transported to a place of unloading where the materials are transferred to a hopper or other storage device. The materials are distributed from this point to the actual destination sites. Since the materials are often exposed during at least part of the handling, there is always the possibility of damage or contamination.

In addition, various problems frequently arise relative to discharging the material from the container. Depending upon the material, interruption of the container unloading operation can result when the discharge means becomes clogged. This frequently occurs when shipping moist or compactible materials which tend to cake or bridge across the discharge opening. This problem has been alleviated in the prior art by using larger discharge openings. However, a large discharge opening often results in loss of control of the material discharged. Smaller discharge openings allow greater control but often require the time-consuming and therefore costly step of clearing blockages.

Prior art receptacles have involved various types of discharge spouts in an attempt to overcome these problems. However, the more involved the spout construction, the greater the cost and time to manufacture the receptacle. As disclosed in U.S. Pat. No. 4,143,796, a discharge spout is formed in the bottom of a material handling receptacle. The bottom is formed when two semi-circular pieces of identical construction are sewn together to allow a free edge in the center which is then bisected by a cut to define a cross-cut positioned centrally in the bottom panel. An opening is thus formed in the bottom by the flaps resulting from the bisecting cuts. A spout assembly is located in the center of the bottom panel and extends through the opening therein formed by the perpendicular cuts. The spout is then sewed at one end to the bottom panel of the receptacle with a single sew line. A closure flap is inserted within the opening beside the spout and sewn to the bottom. The triangular flaps formed from the bisecting cuts are folded over and sewn to form drawstring passageways.

With this construction, the spout is tied with a cord and then rolled up and inserted through the opening into the bottom of the receptacle. The closure flap is then tucked inside the flaps forming the opening and the drawstring, which is inserted in the passageways formed by the flaps being folded over and sewed, is then drawn tight to secure the receptacle opening and allow the receptacle to be filled with flowable materials.

This construction is efficient and performs its function well. However, it may require several time-consuming steps to sew the triangular flaps that form the drawstring passageways and to sew the flap cover and the discharge spout to the bottom panel of the receptacle. In addition, the single sew line fastening one end of the spout to the bottom of the bag (and the closure flap, if desired) may break or become stretched. If so, the tear may go slightly past the sew line and allow product leakage through the extended tears or may allow product to leak through the exposed or stretched needle holes.

The present invention provides an improved discharge spout construction which not only functions in an exceptional manner but also is economical and simple in construction. In this construction, at least three triangular flaps are formed in the bottom panel with intersecting cuts of predetermined length. These triangular flaps form an opening in the bottom panel when they are folded into the interior of the receptacle. A substantially cylindrical spout is formed of flexible material and a substantially circular shaped flap is formed for covering the opening. A double needle sewing machine is preferably used to simultaneously sew one end of each of the folded triangular flaps, only one side of the opening covering flap and one end of the pouring spout to the bottom panel and to each other with a common double threadline or sew line to simultaneously form drawstring passageways, a covering for the opening and the receptacle pouring spout.

When the receptacle is large in size and holds large quantities of material, the weight of the material, as it is forced by gravity out of the receptacle through the discharge spout, has a tendency to tear the outer ends of the intersecting cuts as explained previously in respect to the prior art.

In the present case, a reinforcing web encircles the opening beyond the outer ends of the intersecting cuts forming the triangular flaps and a double needle machine attaches the reinforcing web, the one side of the cover flap, the outer ends of the folded flaps and the one end of the pouring spout simultaneously to each other and to the bottom panel. The reinforcing web prevents tearing of the bottom panel at the outer end of the cuts which form the triangular flaps. When the flowable material is passing through the discharge spout from the receptacle, the reinforcing web prevents the force of the material against the spout from tearing the outer ends of the cuts which formed the triangular flaps. Using a double sew line is significant in this case where it might not normally be important. The reinforcing web with the double sew line eliminates the potential for sifting of product from a tear hole because the second sew line where the discharge hole and the bag bottom meet is $\frac{1}{4}$ inch (the distance between the sew lines) away from where the tear is stopped by the other or first sew line on the reinforcing web. Thus a buffer area is created between the tear and the second sew line. If the first sew line breaks or stretches, the tear may move partially into the buffer area but will still be a slight distance away from the first sew line. Thus the web reinforcement not only reduces the tearing of the cuts but also provides a safety distance between sew lines which reduces product loss through tears or product sifting through exposed needle holes.

Intersecting cuts in the bottom panel of the receptacle can be used to form three triangular flaps. Two bisecting cuts can be utilized to form four triangular flaps and three or more intersecting cuts can be used to form six or more triangular flaps.

SUMMARY OF THE INVENTION

The present invention relates to an improved discharge spout for a collapsible receptacle for flowable materials comprising a substantially cylindrical spout of flexible material, at least three triangular flaps formed in the bottom panel with intersecting cuts of predetermined length, an opening formed in the bottom panel when the triangular flaps are folded into the interior of the receptacle, a substantially circularly shaped flap for covering the opening, means for securing one end of each of the folded flaps to the inner side of the receptacle bottom panel to form drawstring passageways, said securing means minimizing loss of product if the intersecting cuts tend to tear while simultaneously securing the circularly shaped cover flap on only one side of the opening and one end of the cylindrical spout to the bottom panel entirely surrounding the opening on the interior of the receptacle such that the cover flap covers the opening with the spout on the interior of the receptacle, and a drawstring in the drawstring passageways formed by the secured, folded flaps such that when the drawstring is untied, the cover flap and pouring spout can be withdrawn through the opening and when the receptacle is closed, the spout is inside the receptacle, the opening is closed by the cover panel from the inside of the receptacle and the drawstring is drawn and tied to keep the opening securely closed.

The invention also relates to a method of forming a pouring spout in the bottom panel of a collapsible receptacle for flowable product comprising the steps of forming a pouring spout of flexible material, forming at least three triangular shaped flaps in the bottom panel with intersecting cuts of predetermined length, folding the triangular flaps into the interior of the receptacle to form an opening in the bottom panel, placing a flap over the opening to cover the opening, and sewing one end of each of the folded triangular flaps, a part of the opening cover flap on only one side of the opening, and one end of the pouring spout to the bottom panel and to each other so as to create a buffer zone between a tear location and the product to minimize loss of product if an intersecting cut tears, said securing means simultaneously forming drawstring passageways, attaching the covering for the opening and attaching the receptacle pouring spout to the bottom panel.

BRIEF DESCRIPTION OF THE DRAWINGS

A more complete understanding of the invention may be had by reference to the following detailed description when taken in conjunction with the accompanying drawings wherein.

DETAILED DESCRIPTION OF THE DRAWINGS

The construction of the novel discharge spout may be understood by referring to FIGS. 1–9 which illustrate the spout construction and the steps taken in forming the spout.

Figure 1:
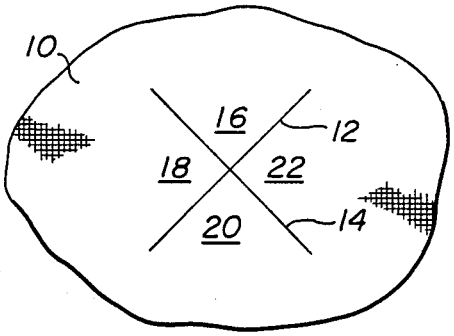
FIG. 1 is a plan view of a portion of the bottom panel illustrating the perpendicular bisecting cuts used to form four triangular flaps which, when folded, form an opening in the bottom panel.

FIG. 1 is a partial view of a bottom panel 10 of a receptacle in which substantially Perpendicular cuts 12 and 14 bisect each other. These cuts form four triangular flaps 16, 18, 20 and 22.

Figure 2:
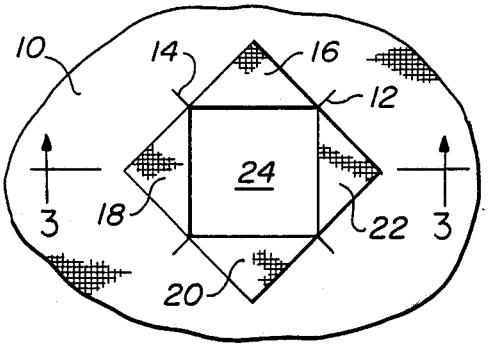
FIG. 2 is a plan view of a portion of the bottom panel of the receptacle illustrating the four triangular flaps folded backwards to form the opening in the bottom of the receptacle.
Figure 3:
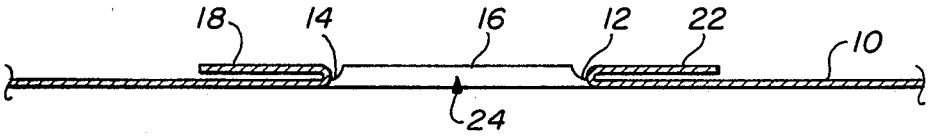
FIG. 3 is a diagrammatic representation of a cross-sectional view of the opening formed in the bottom panel taken along lines 3—3 of FIG. 2.

As can be seen in FIG. 2, when the four triangular flaps 16, 18, 20 and 22 are folded backwards, an opening 24 is formed. FIG. 3 is a cross-sectional view of the opening in FIG. 2 taken along lines 3—3. In FIG. 3, it can be seen that triangular flap 18 has been folded over itself to the left, triangular flap 22 has been folded over itself to the right, and triangular flap 16 has been folded over itself into the plane of the paper.

Figure 4:
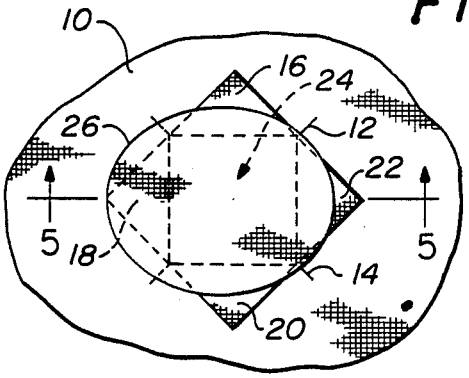
FIG. 4 is a plan view of a portion of the bottom panel of the receptacle illustrating the location of a substantially circular closure flap placed over the opening formed in the bottom panel by folding the triangular flaps backwards.
Figure 5:
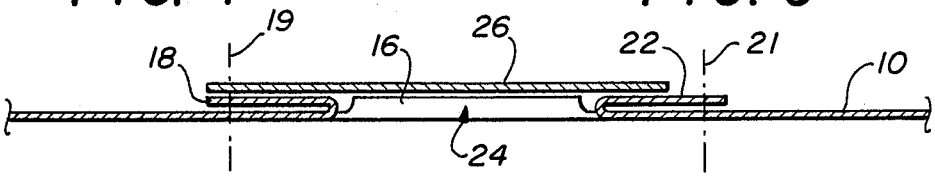
FIG. 5 is a diagrammatic representation of a cross-sectional view of the opening in the bottom panel which is covered by the substantially circular covering flap taken along lines 5—5 in FIG. 4.

FIG. 4 illustrates the opening of FIG. 2 with a substantially circular flap 26 positioned over opening 24. Flap 26 is positioned off-center so that, as will be seen in relation to FIG. 9, only a part of it will be sewn to flap 18 during the final sewing process and it will not be sewn to flaps 16, 20 or 22. FIG. 5 is a cross-sectional representation of the opening shown in FIG. 4 taken along lines 5—5. Thus, in FIG. 5 it can be seen that if the sew line 19 is toward the outer end of flap 18, that a part of only one end of flap 26 would be sewn to the triangular flap 18 and no part of flap 26 would be sewn to triangular flap 22 by sew line 21.

Figure 6:
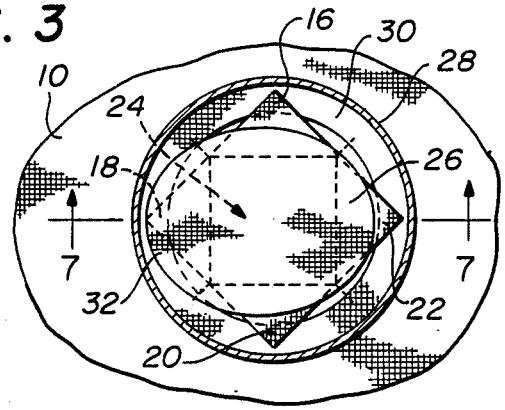
FIG. 6 is a plan view of a portion of the bottom panel of the receptacle illustrating the placement of the pouring spout under the outer ends of the folded triangular flaps and the covering flap preparatory to being sewn to the bottom panel.
Figure 7:
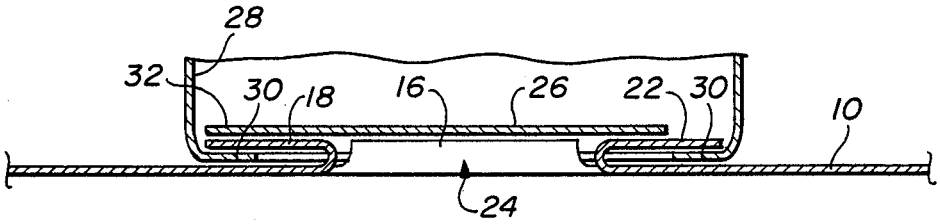
FIG. 7 is a cross-sectional diagrammatic representation of the spout assembly in FIG. 6 taken along lines 7—7.

FIG. 6 is a plan view of a portion of the bottom panel 10 taken from inside the receptacle and illustrating the addition of the pouring spout 28 to the construction shown in FIG. 4. It will be noted in FIG. 6 that the inner edge 30 of one end of the spout 28 passes under the outer ends of each of the triangular flaps 16, 18, 20 and 22 as well as under only a part 32 of one side of circular cover flap 26 near triangular flap 18. Near triangular flap 22, it will be seen that the bottom edge 30 of the spout 28 does pass under triangular flap 22 but doe not pass under circular cover flap 26. Thus, when the elements are all sewn together, triangular flap 26 will be sewn only on the portion 32 of cover flap 26 near triangular flap 18. FIG. 7 is a cross-sectional representation of the spout construction shown in FIG. 6 and taken along lines 7—7. As can be seen in FIG. 7, the end portion 30 of spout 28, the leftmost portion 32 of circular cover 26 and folded triangular flap 18 are all in alignment on the left side so that a common thread seam could join all of them together. However, on the right side, only bottom panel 10, triangular flap 22 and end 30 of spout 28 can be joined together by a common thread seam.

Figure 8:
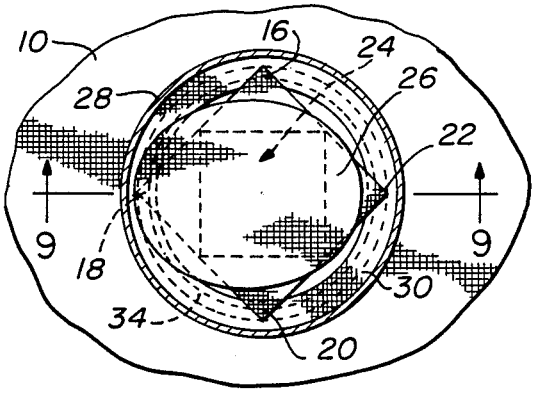
FIG. 8 is a plan view of a portion of the bottom panel of the receptacle taken from the inside of the receptacle illustrating the addition of the reinforcing web which, when sewn, joins one end of each of the folded triangular flaps, a part of the opening cover flap on only one side of the opening and one end of the pouring spout to the bottom panel and to each other with a double threaded seam to simultaneously form drawstring passageways, attach the covering for the opening and attach the receptacle pouring spout to the bottom panel.

FIG. 8 is a plan view of a portion of bottom panel 10 taken from the inside of a receptacle illustrating the addition of a reinforcing web 34 to the construction shown in FIG. 6. As more clearly seen in FIG. 9, which is a cross-sectional representation of the construction in FIG. 8 taken along lines 9—9, reinforcing web 34 is in a circular shape surrounding the opening 24. On the left side in FIG. 9, a double stitch row 36 attaches the reinforcing web 34, the triangular flap 18, only a part of one side of the substantially circular flap 26, and the end 30 of the substantially cylindrical spout 28, while the double seam 36 on the right side of FIG. 9 joins only the reinforcing web 34, the bottom panel 10, flap 22 and bottom end 30 of the cylindrical spout 28.

Figure 10:
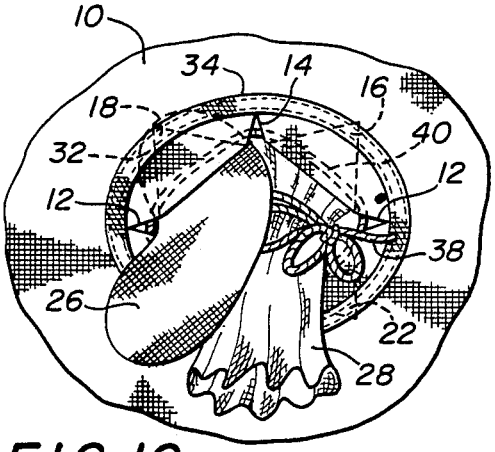
FIG. 10 is an enlarged bottom perspective view of the discharge spout when the spout is removed from the interior of the bag through the opening formed by the folded triangular flaps and illustrating the placement of the reinforcing web at the outer ends of the cuts forming the triangular flaps to reduce the tearing of the cuts beyond the reinforcing web.
Figure 15:
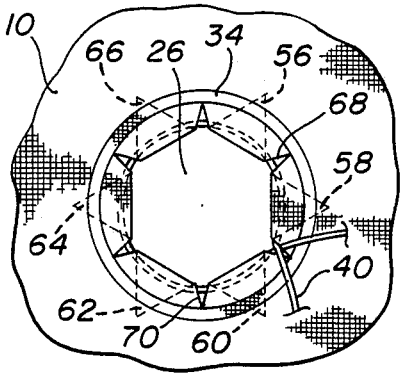
FIG. 15 is a plan view of a portion of the bottom panel of the receptacle illustrating a hexagonal opening with the drawstring securing the opening and the reinforcing web placed the outer ends of the cuts forming the triangular flaps to reduce tearing of the cuts.

FIG. 10 is a perspective view of a portion of bottom panel 10 illustrating the novel construction of the discharge spout and showing the discharge spout 28 in its external position. Cover flap 26 has been pulled out of the opening 24 and a cord 38 secures spout 28. When the cord 38 is untied, the product can be dispensed from the receptacle. It will be noted that the reinforcing web 34 surrounds the opening 24 just beyond the ends of the cuts 12 and 14 which are used to form the triangular flaps 16, 18, 20 and 22. The distance between the double sew lines is approximately ¼ inch and that area forms a buffer zone which separates the ends of the cuts 12 and 14 (where tears are most likely to forms) from the product in the receptacle. Thus, if cut 12 or 14 tends to tear beyond the first sew line, the second sew line prevents product loss through the tear or the holes formed by the sewing needles. Thus, tearing of the cuts 12 and 14 beyond the reinforcing web 34 is inhibited or reduced. When the bag is empty, the cord 38 is tied around the spout 28 and the spout 28 is pushed back into the interior of the bag through the opening 24. The cover flap 26 is then inserted through the opening 24 to the interior of the bag and drawstring 40 is tightened, thus closing the opening as shown in FIG. 15.

Figure 11:
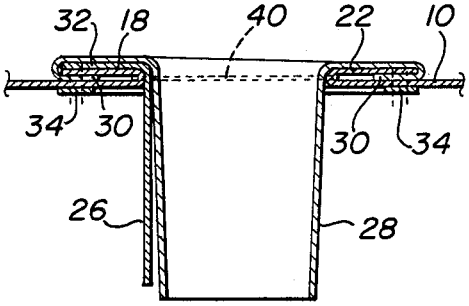
FIG. 11 is a diagrammatic representation of a cross-section of the novel spout construction shown with the spout removed from the inside of the bag or receptacle.

FIG. 11 is a cross-sectional view of the novel spout 28 when it is removed from the interior of the bag. The cover flap 26 is removed from the interior of the bag and the spout 28 is pulled out of the bag or receptacle. Again, on the left side, it can be seen that a double row of stitches or seams joins the bottom panel of the receptacle 10, the triangular flap 18, the lower end 30 of the spout 28 and the left end 32 of the cover flap 26. On the right side, the double seams join the reinforcing web 34, the bottom panel of receptacle 10, triangular flap 22 and the bottom 30 of the spout 28.

Figure 12:
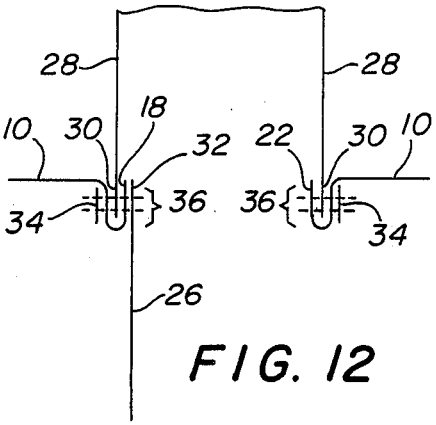
FIG. 12 is a line drawing illustrating the manner in which the bottom panel triangular flaps, the discharge spout and the cover flap are all sewn together with the reinforcing web.
Figure 9:
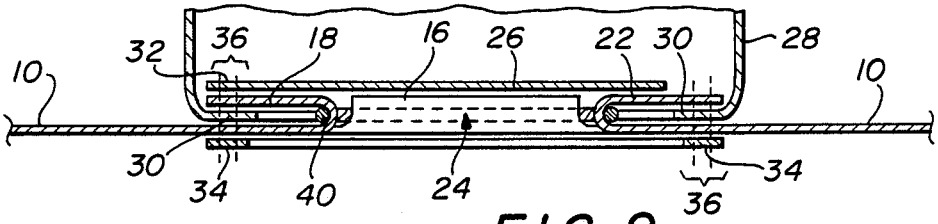
FIG. 9 is a diagrammatic representation of a cross-sectional view of the pouring spout construction shown in FIG. 8 and taken along lines 9—9.

FIG. 12 is a line drawing illustrating the manner in which the various panels are sewn together. On the left, the bottom panel 10 has the triangular shaped flap 18 folded backwards over the end 30 of spout 28. On the outside of triangular flap 18 is one end 32 of the covering flap 26. On the outside of the bottom panel 10 is the reinforcing web 34. A double row of stitches 36 interconnects the reinforcing web 34, bottom panel 10, the end portion 30 of spout 28, triangular flap 18 and one end 32 of the cover flap 26 on the left side of FIG. 12. On the right side it can be seen that bottom panel 10 has triangular flap 22 folded over the lower end 30 of the spout 28. On the outside of the bottom 10 is the continuation of the reinforcing web 34. The double row of stitches 36 thus joins the reinforcing web 34, bottom panel 10, the lower end 30 of the spout 28 and triangular flap 22.

Thus, it can be seen from FIG. 12 that with one pass of a double needle sewing machine, the spout is formed in the bottom panel 10 with a cover flap 26. Thus, the novel discharge spout is very easily constructed when compared to the prior art and yet is strengthened to prevent loss of product by tearing of the cuts forming the opening and provides a cover flap for sealing the bottom of the container or receptacle when it is full of material.

Figure 13:
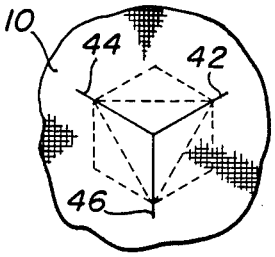
FIG. 13 is a plan view of a portion of a bottom panel illustrating an opening formed with three intersecting cuts to form three triangular flaps.

FIG. 13 illustrates a portion of a bottom panel 10 illustrating the use of three intersecting cuts 42, 44 and 46 to enable three triangular flaps to be formed as indicated by the dashed lines.

Figure 14:
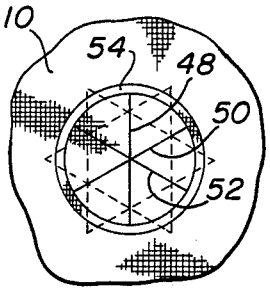
FIG. 14 is a plan view of a portion of a bottom panel illustrating three intersecting cuts used to form six triangular flaps which when folded back form a hexagonal opening and illustrating the placement of the reinforcing web to reduce tearing of the cuts at their outermost ends.

In like manner FIG. 14 illustrates the use of three intersecting lines 48, 50 and 52 to form six triangular flaps as indicated by the dashed lines. It will be noted that the reinforcing web 54 is positioned so that it can be sewn into each of the triangular flaps just on the outside of the end of the cuts 48, 50 and 52 to prevent the cuts from tearing, create a buffer zone between the two seams, and reduce product loss.

FIG. 15 is an illustration of a portion of the bottom panel 10 from under the receptacle indicating the appearance of the novel spout when the receptacle is closed. Again, it can be seen that the reinforcing web 34 is positioned such that it can be sewn to each of the triangular flaps 56, 58, 60, 62, 64 and 66 and yet forms the buffer zone between the two seams, all of which lies just outside the ends of the cuts such as indicated at 68 and 70.

Thus, there has been disclosed an improved discharge spout for a collapsible receptacle that is simple and relatively easy to construct and yet performs the function of providing a spout which can be sealed in the bag and yet withdrawn as needed to dispense the contents of the receptacle.

Only the preferred embodiment of the invention has been described. It should be understood that the invention is not limited to the embodiments disclosed, but is intended to embrace any alternatives, modifications, rearrangements, or substitutions of parts or elements as fall within the spirit and scope of the invention.

We claim:

1. An improved discharge spout in the bottom panel of a collapsible receptacle for flowable products comprising:

a substantially cylindrical spout of flexible material;

at least three triangular flaps formed in the bottom panel with intersecting cuts of predetermined length, the outer ends of said cuts forming potential tear locations;

an opening formed in the bottom panel when the triangular flaps are folded into the interior of the receptacle;

a substantially circularly shaped flap for covering the opening;

means for securing one end of each of the folded flaps to the inner side of the receptacle bottom panel beyond the outer ends of said cuts of predetermined length to form drawstring passageways, said securing means creating a tear resistant buffer zone of predetermined width between a potential tear location and the product to minimize loss of product if said intersecting cuts tend to tear; said securing means simultaneously securing a portion of the circularly shaped cover flap on only one side of the opening and one end of the cylindrical spout to the bottom panel entirely surrounding the opening on the interior of the receptacle such that the cover flap covers the opening with the spout on the interior of the receptacle; and a drawstring in the drawstring passageways formed by the secured, folded flaps such that when the drawstring is untied, the cover flap and pouring spout can be withdrawn through the opening and when the receptacle is closed, the spout is inside the receptacle, the opening is closed by the cover panel from the inside of the receptacle and the drawstring is drawn and tied to keep the opening securely closed.

2. An improved panel as in claim 1 wherein said securing means comprises:

a reinforcing web encircling said opening beyond the outer ends of the intersecting cuts; and a double sew line attaching the web, one side of the cover flap, the outer end of each of the folded triangular flaps and said one end of the pouring spout to each other and to the bottom panel, the area between the sew lines creating a buffer from any tear that goes past the first sew line because of a broken thread or a stretched thread so as to minimize loss of product.

3. An improved panel as in claim 2 wherein two substantially bisecting cuts are used to form four triangular flaps.

4. An improved panel as in claim 2 wherein three intersection cuts are used to form six triangular flaps.

5. A collapsible receptacle for a flowable product having an improved pouring spout in a bottom panel and comprising:

a pouring spout of flexible material;

at least three triangular shaped flaps formed by the intersection of cuts of predetermined length in the bottom panel, the outer ends of said cuts forming potential tear locations;

an opening in the bottom panel formed by folding the triangular shaped flaps into the interior of the receptacle;

a flap placed over and covering the opening on the interior of the receptacle; and means securing one end of each of the folded triangular shaped flaps, a part of the opening cover flap on only one side of the opening, and one end of the pouring spout to the bottom panel and to each other beyond the outer ends of said cuts of predetermined length so as to create a tear resistant buffer zone of predetermined length between any potential tear locations and the product to minimize loss of product if said intersecting cuts tend to tear, and to simultaneously form drawstring passageways, attach the covering for the opening and attach the receptacle pouring spout to the bottom panel.

6. A method of forming a pouring spout in the bottom panel of a collapsible receptacle for flowable product comprising the steps of:

forming a pouring spout of flexible material;

forming at least three triangular shaped flaps by the intersection of cuts of predetermined length in the bottom panel, the outer ends of said cuts forming potential tear locations;

folding said triangular flaps into the interior of the receptacle to form an opening in the bottom panel;

placing a flap over said opening to cover the opening; and sewing one end of each of the folded triangular flaps, a part of the opening cover flap on only one side of the opening, and one end of the pouring spout to the bottom panel and to each other beyond the outer ends of said cuts of predetermined length so as to create a tear resistant buffer zone of predetermined width between a potential tear location and the product to minimize loss of product if the intersecting cuts tend to tear and to simultaneously form drawstring passageways, attach the cover flap for the opening and attach the receptacle pouring spout to the bottom panel.

7. A method as in claim 6 further including the steps of:

encircling the opening beyond the outer ends of the intersecting cuts where tears may occur with a reinforcing web; and using a double sew line to attach said reinforcing web, one side of said cover flap, the outer ends of the folded triangular flaps and the one end of the pouring spout to each other and to the bottom panel, said double sew line creating a buffer zone between the cut tears and the product in the bag to minimize loss of product through the tears or sewing needle holes.

8. A method as in claim 7 further including the step of forming two substantially bisecting cuts to form four triangular flaps.

9. A method as in claim 7 further including the step of forming three intersecting cuts to form six triangular flaps.

* * * * *